US006330015B1

(12) United States Patent
Imai et al.

(10) Patent No.: US 6,330,015 B1
(45) Date of Patent: Dec. 11, 2001

(54) THICK FILM THERMAL HEAD

(75) Inventors: Ryoichi Imai; Junichi Terauchi, both of Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/635,656

(22) Filed: Aug. 10, 2000

(30) Foreign Application Priority Data

Aug. 11, 1999 (JP) ..... 11-227329

(51) Int. Cl.[7] ..... B41J 2/335
(52) U.S. Cl. ..... 347/208
(58) Field of Search ..... 347/200, 206, 347/202, 203, 208, 204; 101/114, 127

(56) References Cited

U.S. PATENT DOCUMENTS 4,030,408 6/1977 Miwa .
4,259,564 * 3/1981 Ohkubo et al. ..... 347/208
4,777,583 * 10/1988 Minami et al. ..... 347/208
5,072,236 * 12/1991 Tatsumi et al. ..... 347/203
6,253,447 * 7/2001 Nakamura et al. ..... 347/208

FOREIGN PATENT DOCUMENTS 60 198263 10/1985 (JP) .
63 165153 7/1988 (JP) .

* cited by examiner

*Primary Examiner*—N. Le
*Assistant Examiner*—K. Feggins
(74) *Attorney, Agent, or Firm*—Nixon Peabody LLP; Donald R. Studebaker

(57) ABSTRACT

A thick film thermal head includes an electrical insulating substrate and a photosensitive material layer which is formed on the substrate and is provided with a linear groove formed on a surface thereof by exposing it to light. An elongated resistance heater is embedded in the groove, and a plurality of electrodes are formed on the surface of the photosensitive material layer in contact with the resistance heater and arranged in the longitudinal direction of the resistance heater.

4 Claims, 4 Drawing Sheets

THICK FILM THERMAL HEAD

BACKGROUND OF THE INVENTION

1. Field of the Invention

This invention relates to a thick film thermal head which is employed to thermally perforate a stencil material to make a stencil to be used in an image forming apparatus such as a stencil printer.

2. Description of the Related Art

As the thermal head used in various image forming apparatuses, there have been known a thin film thermal head and a thick film thermal head. The former is formed by the use of thin film forming technique and the latter is formed by the use of technique other than the thin film forming technique. When perforating a heat-sensitive stencil material by the use of such a thermal head, it is required that adjacent perforations are clearly separated in order to obtain a high printing quality.

A thick film thermal head has been used in a heat-sensitive printing system and a ribbon transfer printing system. The thick film thermal head comprises an insulator substrate such as of ceramic, a plurality of electrodes formed on the substrate and a resistance heater formed on the electrodes. When power is supplied to the electrodes, the resistance heater generates heat from the lower surface thereof in contact with the electrodes and the heat propagates the resistance heater to the upper surface thereof where the resistance heater is brought into contact with a recording medium. In this thermal head, the resistance heater extends across the electrodes and the parts of the resistance heater between the electrodes form resistance heater elements, and each pixel of the image formed by the thermal head becomes larger than the heater element, which results in pixels contiguous to each other.

When the thick film thermal head is used for making a stencil, each of the perforations becomes too large since the heat generated from the lower surface of each of the resistance heater elements spreads over a wide area while the heat propagates to the upper surface of the heat element, and at the same time, it takes a long time for the temperature of the surface of each heater element to reach a perforating temperature, which results in poor response of the thermal head.

Further, in the case of a stencil printer, ink is apt to spread when transferred to the printing paper through the perforations of the stencil and is apt to form printing dots larger than the perforations of the stencil. Accordingly, the perforations of the stencil should be smaller by an amount corresponding to spread of the ink and should be discrete from each other. From this viewpoint, the aforesaid thermal head where heat is generated from the lower surface of the resistance heater elements is not suitable for making a stencil.

In a thermal head having a linear array of resistance heater elements extending in a main scanning direction (in the direction of width of a stencil), though the size of the perforations in the main scanning direction can be reduced by narrowing the intervals at which the electrodes are arranged, it is difficult to reduce the size of the perforations in the sub-scanning direction (the direction in which the stencil is conveyed) due to difficulties in narrowing the width of the resistance heater and influence of heat diffusion.

That is, conventionally, the thick film thermal head is formed by coating resistance heater paste by silk screening on electrodes b formed on a substrate a as shown in FIG. 10. Though the resistance heater paste forms a narrow protrusion as shown by chained line c immediately after coating, it is flattened in the sub-scanning direction with lapse of time as shown by the solid line d. This phenomenon occurs because the resistance heater paste is flowable and there is provided no member for limiting spread of the paste, and makes it difficult to form a narrow resistance heater.

As disclosed, for instance, in Japanese Unexamined Patent Publication No. 63(1988)-165153, there has been proposed a structure in which a heat accumulator layer is formed on an insulating substrate such as of ceramic, a resistance heater is embedded in a groove formed on the heat accumulator layer, and electrodes are formed over the resistance heater for the purpose of making each heat generating area larger than the resistance heater element corresponding thereto and making the pixels contiguous to each other. However this structure of a thermal head is not suitable for making a stencil. That is, when the thermal head is used for thermally perforating a heat-sensitive stencil material, heat generated by each resistance heater element accumulates in the heat accumulator layer and spreads wide, which can result in enlarged or connected perforations. Further the heat accumulator layer deteriorates the speed of response to heat (heat dissipating speed).

There has been known also a thick film thermal head in which a resistance heater in the form of a protrusion is formed on electrodes on a substrate. This type of thermal head is disadvantageous in that paper grounds or resin grounds is peeled off the stencil material by the protruding resistance heater when the stencil material is moved relative to the thermal head during stencil making. The paper grounds or the resin grounds adheres to the surface of the protruding resistance heater and adversely affects stencil making, e.g., prevents the resistance heater from being brought into a close contact with the stencil material and causes the resistance heater to fail in perforating the stencil material.

Due to the difficulties described above, a thin film thermal head has been generally employed for perforating a heat-sensitive stencil material. The thin film thermal head is advantageous in that the resistance heater is of a thin film and accordingly the heat generating area for each resistance heater element can be small, which results in small perforations. However, the thin film thermal head is disadvantageous in that its manufacturing cost is high. That is, the thin film thermal head is manufactured by the use of semiconductor manufacturing technology and expensive apparatuses such as a sputtering apparatus or a vacuum deposition apparatus and high technique are required. At the same time, materials for forming the thermal head are expensive. Further, the semiconductor manufacturing apparatuses are generally for making integral circuits and the like and are not able to produce a large size (e.g., for A2 or larger size) thermal head by one step. Accordingly, a large size thermal head must be produced by incorporating a plurality of small thermal head segments, which gives rise to a problem that heat generation becomes unsatisfactory at junctions between the segments, which can result in white stripes on prints.

To the contrast, the thick film thermal head can be made at low cost, for instance, by screen printing, and can be easily made in a large size.

SUMMARY OF THE INVENTION

In view of the foregoing observations and description, the primary object of the present invention is to provide a thick film thermal head which is improved in perforating properties. That is, the primary object of the present invention is to provide a thermal head which can be produced at low cost and in a large size and, at the same time, can form small discrete perforations in a heat-sensitive stencil material at high response to heat.

In accordance with the present invention, there is provided a thick film thermal head comprising an electrical insulating substrate, a photosensitive material layer which is formed on the substrate and is provided with a linear groove formed on a surface thereof by exposing it to light, an elongated resistance heater embedded in the groove, and a plurality of electrodes which are formed on the surface of the photosensitive material layer in contact with the resistance heater and arranged in the longitudinal direction of the resistance heater.

It is preferred that the electrodes comprise alternate first and second electrodes and the parts of the elongated resistance heater between the first and second electrodes generate heat when electric power is applied across the first and second electrodes.

It is preferred that the substrate is of calcined ceramic, and the photosensitive material layer is of heat-resistant photo-setting resin.

The linear groove formed in the photosensitive material layer may be rectangular, U-shaped, V-shaped or trapezoidal in cross-section.

In the thick film thermal head in accordance with the present invention, since the resistance heater is embedded in the groove, the width of the resistance heater is limited to the width of the groove. Further, since the electrodes are in contact with the surface of the resistance heater which is brought into contact with the stencil material when making a stencil, heat is generated from the surface of the resistance heater which is brought into contact with the stencil material and applied to the stencil material before propagating over a large distance and spreading wide. Accordingly, with the thermal head of the present invention, perforations can be small even in the sub-scanning direction and the quality of the stencil can be improved so that the printing dots can be sufficiently small in size and the printing quality is improved. Further since being of a thick film type, the thermal head of the present invention can be produced at low cost without using a semiconductor manufacturing apparatus and can be produced in a large size. Accordingly, even a large size thermal head can be employed in printing without fear of generating a white stripe on prints.

Further, since heat which does not contribute to perforation of the stencil material is dissipated through the side walls and the bottom of the groove, the thermal head of the present invention is increased in its response to heat and can be operated at a high speed.

DESCRIPTION OF THE PREFERRED EMBODIMENT

Figure 1:
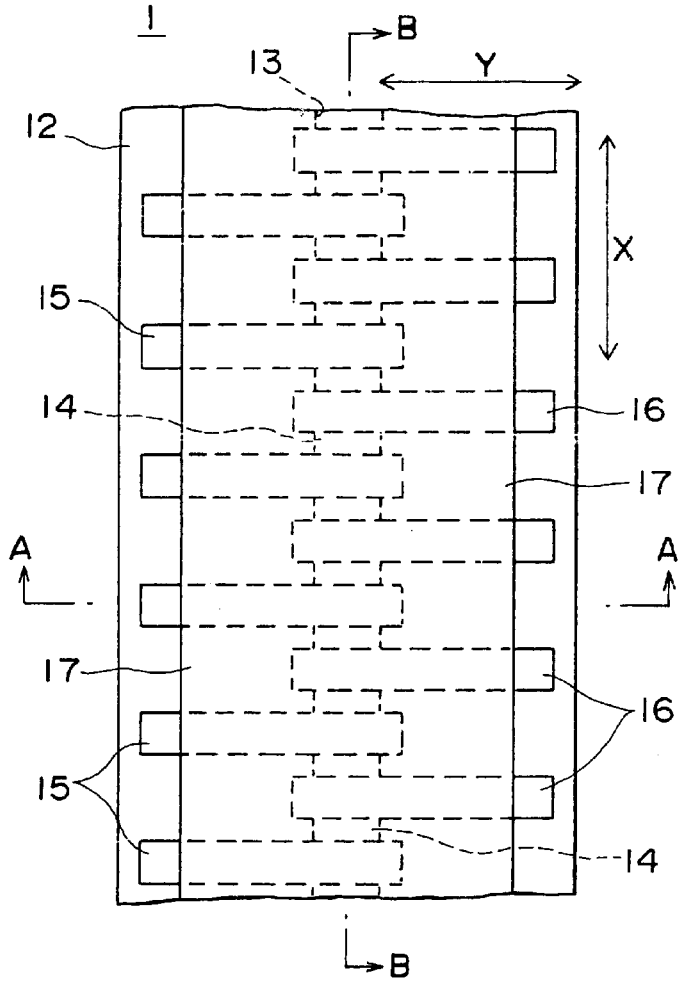
FIG.1 is a fragmentary plan view of a thermal head in accordance With an embodiment of the present invention.
Figure 2:
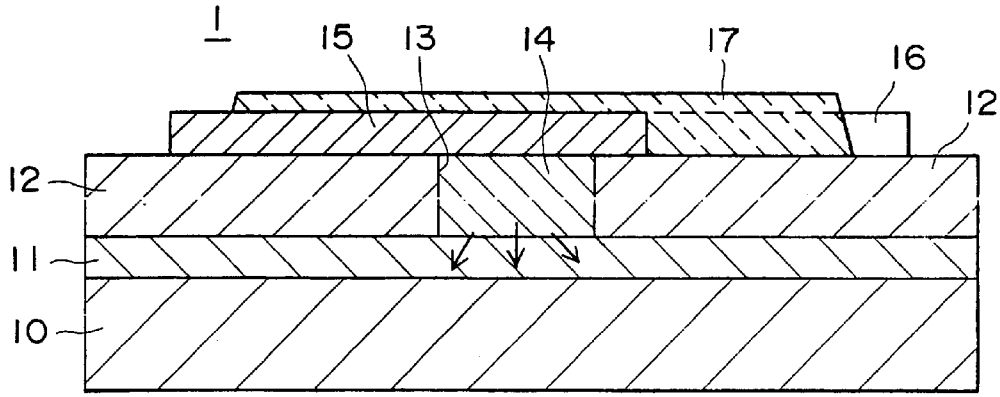
FIG. 2 is a cross-sectional view taken along line A—A in FIG. 1.
Figure 3:
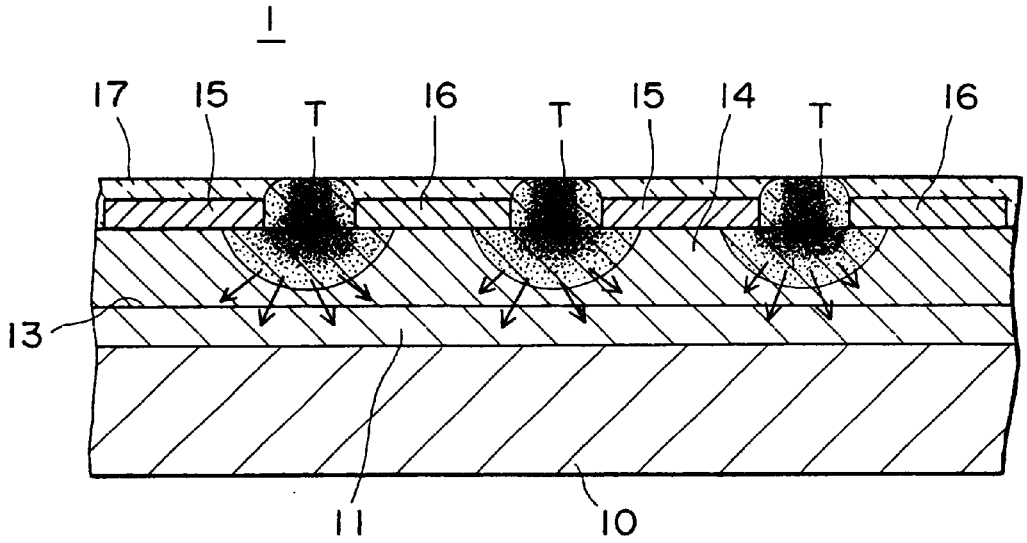
FIG. 3 is a cross-sectional view taken along line B—B in FIG. 1.

In FIGS. 1 to 3, a thick film thermal head 1 in accordance with an embodiment of the present invention comprises a substrate 10 which is formed of an electrical insulating ceramic material such as calcined ceramic. A heat conductive layer 11 which is formed of an electrical insulating material high in heat conductivity such as an aluminum oxide plate whose surface is oxidized is bonded to the upper surface of the substrate 10, for instance, by adhesive. A photosensitive material layer 12 is of heat-resistant photo-setting resin is superposed on the heat conductive layer 11. A linear groove 13 which is rectangular in cross-section is formed on the upper surface of the photosensitive material layer 12 and an electrical conductive resistance heater 14 is embedded in the groove 13. First and second strip-like electrodes 15 and 16 are formed on the resistance heater 14 to extend across the resistance heater 14. The first and second electrodes 15 and 16 are alternately arranged in the longitudinal direction of the resistance heater 14. The first and second electrodes 15 and 16 are in contact with the resistance heater 14 at their one end portions and extend in opposite directions from their respective one end portions. A wear-resistant film (protective layer) 17 which is of glass or the like and has a flat upper surface is formed to cover the resistance heater 14 and the central portions of the first and second electrodes 15 and 16. The thermal head 1 of this embodiment is brought into contact with a stencil material at the upper surface of the wear-resistant film 17.

The linear groove 13 is formed, for instance, by exposing the photo-setting resin layer formed on the heat conductive layer 11 to light except the part at which the linear groove 13 is to be formed, thereby solidifying the photo-setting resin layer, and subsequently removing unexposed part of the photo-setting resin layer by solvent.

The first and second electrodes 15 and 16 are connected to a control circuit (e.g., a driver IC) through wire bonding.

As shown in FIG. 3, when power is applied to the first and second electrodes 15 and 16, parts of the resistance heater 14 between the first and second electrodes 15 and 16 generates heat from the upper surface thereof. The heat T is transferred through the wear-resistant film 17 toward the upper surface thereof and thermally perforates the stencil material. (In FIG. 3, the parts where the density of black dots is high are high in temperature.) That is, each of the parts of the resistance heater 14 between the first and second electrodes 15 and 16 corresponds to one perforation and forms one resistance heater element. Further, as shown in FIGS. 2 and 3, the heat generated by the resistance heater 14 is transferred to the heat conductive layer 11 through the bottom surface of the resistance heater 14 and dissipated.

As shown in FIG. 1, the longitudinal direction of the resistance heater 14 is the main scanning direction X corresponding to the direction of width of the stencil material and the direction perpendicular to the main scanning direction X is the sub-scanning direction Y corresponding to the direction in which the stencil material is conveyed.

Though the linear groove 13 is rectangular in cross-section in the embodiment described above, the linear groove may be U-shaped, V-shaped or trapezoidal in cross-section. The cross-sectional shape of the groove 13 can be of a desired shape by selecting the material of the photosensitive material layer 12 and selecting the exposure/development processing. When the cross-sectional shape of the groove 13 differs, transfer of heat to the heat conductive layer 11 somewhat differs though heat generating characteristic is substantially the same.

Figure 4:
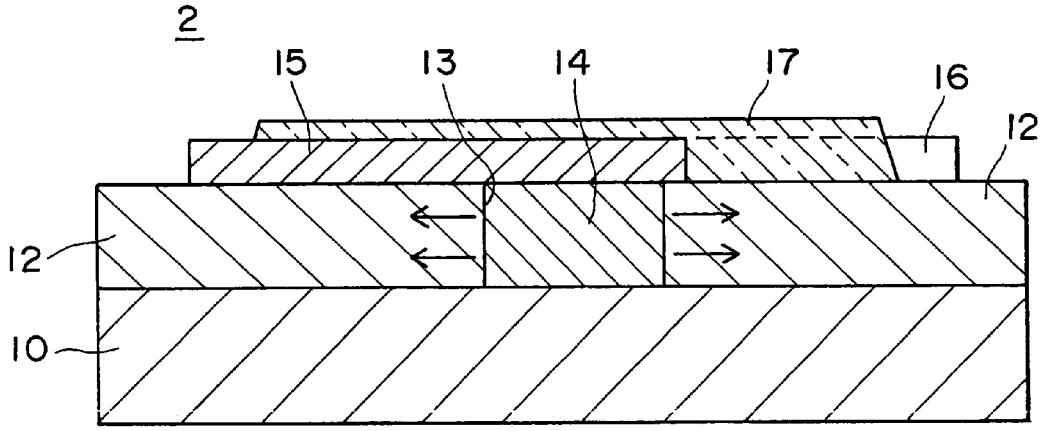
FIG. 4 is a cross-sectional view of a thermal head in accordance with another embodiment of the present invention.

FIG. 4 shows a thermal head 2 in accordance with another embodiment of the present invention. The thermal head 2 of this embodiment differs from the thermal head 1 of the embodiment described above in that the heat conductive layer 11 is removed and instead the photosensitive material layer 12 is of a material which is high in heat conductivity. That is, the photosensitive material layer 12 doubles as the heat conductive layer.

An example of manufacturing steps of the thermal head 1 shown in FIGS. 1 to 3 will be described with reference to FIGS. 5 to 9, hereinbelow. The manufacturing steps basically comprise the steps of forming the heat conductive layer 11 and the photosensitive layer 12 on the substrate 10 in this order, forming the linear groove 13 on the photosensitive layer 12, embedding the resistance heater 14 in the groove 13, forming the electrodes 15 and 16 by forming metal film over the substrate 10 and photo-etching the metal film into electrodes, and forming the wear-resistant film 17.

Figure 5:
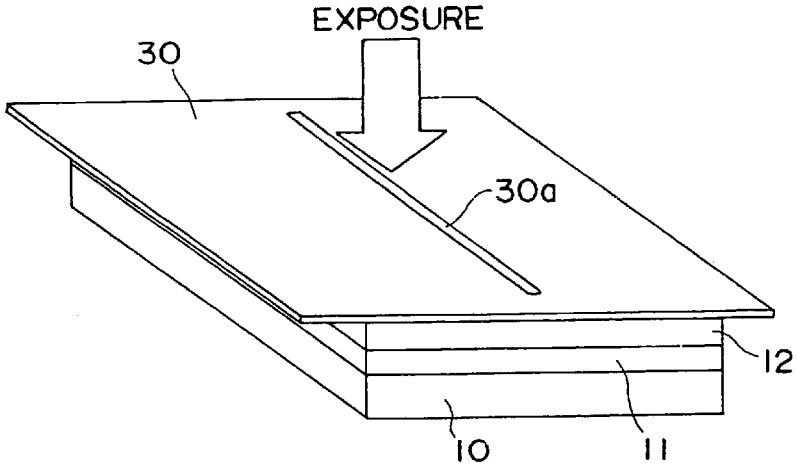
FIGS. 5 to 9 are views for illustrating an example of manufacturing steps of the thermal head.

As shown in FIG. 5, an electrical insulating ceramic substrate 10 of a predetermined thickness is first prepared and a thin aluminum oxide plate whose surface is oxidized is bonded to the upper surface of the substrate 10, thereby forming a heat conductive layer 11. Then heat-resistant photosensitive resin (e.g., heat-resistant photosensitive polyimide obtained by introducing acryloyl into polyimide) is coated on the heat conductive layer 11 and the heat-resistant photosensitive resin layer is covered with a mask 30 having a light-shielding portion 30*a* at the part at which a linear groove 13 is to be formed. Then the heat-resistant photosensitive resin layer is exposed to light through the mask 30 for a predetermined time. As a result, the part of the photosensitive resin layer exposed to the light is solidified to form a photosensitive material layer 12 with the unexposed part left unsolidified. Then the mask 30 is removed, and the unsolidified resin is removed by predetermined solvent, whereby a linear groove 13 is formed.

The photosensitive material layer 12 may be of various heat-resistant photosensitive resins or the like which are solidified or decomposed upon exposure to visible light, ultraviolet rays, electron rays, X-rays or the like. The heat-resistant photosensitive resin is exposed to light using a mask suitable for the resin, and the part of the resin corresponding to the groove 13 is removed by suitable solvent.

When the groove 13 is formed in a width of 20 to 50 $\mu$m, a thermal head having a resolution of 40 dpi can be obtained. The depth of the groove 13 depends upon the thickness of the photosensitive material layer 12 and is generally 30 to 50 $\mu$m.

Figure 6:
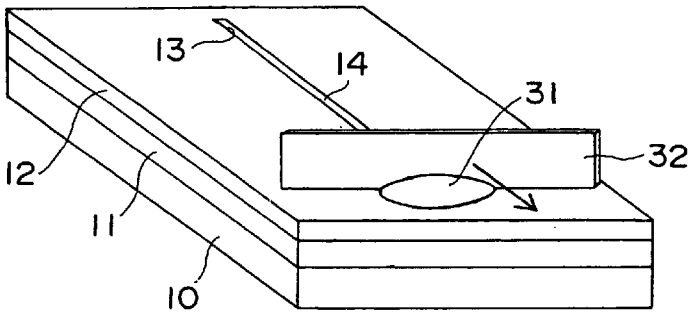

Then paste 31 for forming a resistance heater 14 is filled in the linear groove 13 by a squeegee 32 as shown in FIG. 6. Then the paste 31 is baked and solidified, thereby forming the resistance heater 14. Though ruthenium oxide paste is suitable for the paste 31, electrical conductive carbon paste may be used.

Figure 7:
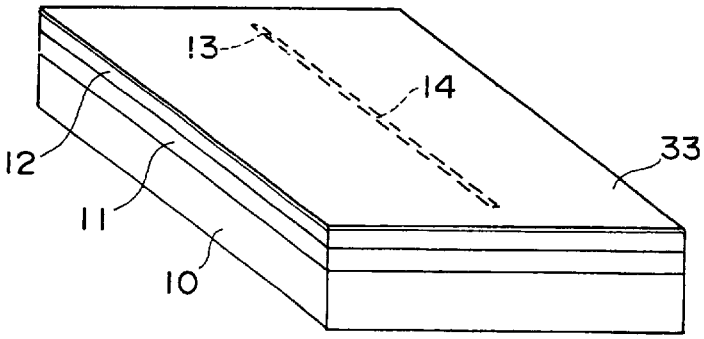

Thereafter metal film 33 of paste of gold or other metal for forming the electrodes 15 and 16 is formed over the entire upper surface of the substrate 10 including the upper surface of the resistance heater 14 by silk screening as shown in FIG. 7. The metal film 33 is subsequently heated to be fixed.

Figure 8:
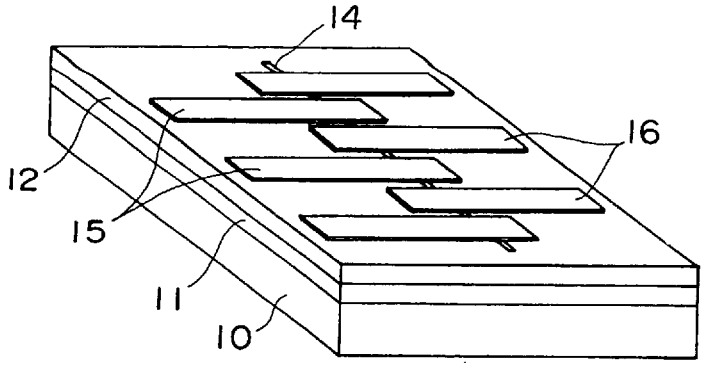

Then photoresist is coated over the fixed metal film 33 and is exposed to light in a pattern of first and second electrodes 15 and 16. Then the photoresist is developed and removed to expose the metal film 33 except the parts corresponding to the electrodes 15 and 16. The exposed part of the metal film 33 is removed by etching with the part covered with the photoresist left there, whereby the first and second electrodes 15 and 16 are formed in a predetermined pattern as shown in FIG. 8.

Figure 9:
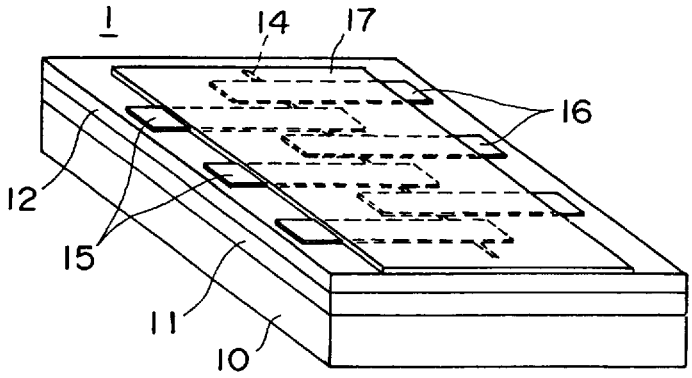
Figure 10:
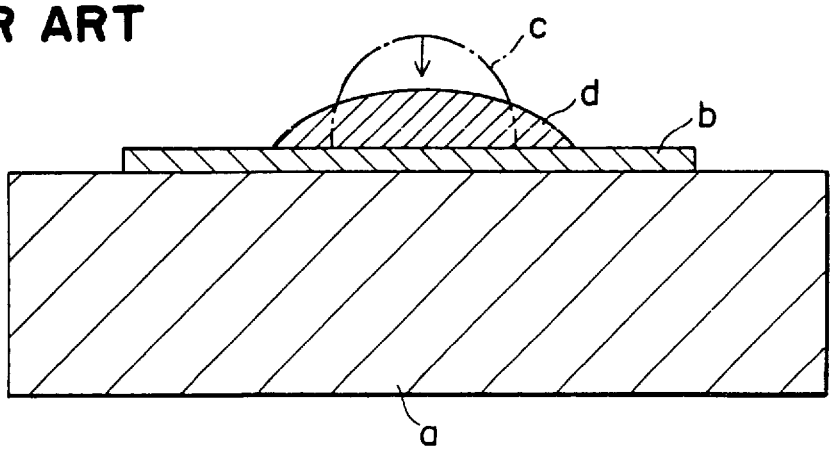
FIG. 10 PRIOR ART
FIG. 10 is a cross-sectional view showing formation of the resistance heater in a conventional thick film thermal head.

Thereafter, a glass composition is coated over the resistance heater 14 and the electrodes 15 and 16 with the outer end portions of the electrodes 15 and 16 exposed as shown in FIG. 9, and is heated to form a wear-resistant film 17, thereby obtaining a thermal head 1.

A driver IC is mounted and wire bonding step is carried out on the thermal head 1 thus obtained before the thermal head 1 is incorporated in a stencil making section of a stencil printer.

In the thick film thermal heads in accordance with the embodiments described above, since the electrodes 15 and 16 are in contact with the surface of the resistance heater 14 which is brought into contact with the stencil material when making a stencil, heat is generated from the surface of the resistance heater 14 which is brought into contact with the stencil material and applied to the stencil material before propagating over a large distance and spreading wide. Accordingly, perforations can be small in size and resolution of the stencil can be improved, and at the same time, response to heat of the thermal head is improved. Further since being of a thick film type, the thermal heads can be produced at low cost without using a semiconductor manufacturing apparatus and can be produced in a large size.

Further, since the resistance heater 14 is in contact with the heat conductive layer 11 or the photosensitive layer 12 which is high in heat conductivity, heat generated by the resistance heater 14 is constantly dissipated and the heat generating areas cannot spread wide.

Further, since the resistance heater 14 is embedded in the groove 13, the width of the resistance heater 14 is limited to the width of the groove 13, whereby the heat generating areas can be confined narrow also in the sub-scanning direction and the size of the perforations can be small also in the sub-scanning direction. Further since the thermal heads of the embodiments described above are flat at the surface to be brought into contact with the stencil material, resin grounds cannot be generated during perforation of the stencil material.

Further, in the embodiments described above, the exposure system for forming the first and second electrodes 15 and 16 can be employed to form the linear groove 13 by exposing the photosensitive material layer 12 to light. Accordingly, as compared with the case where the groove 13 is formed by physical processing such as grinding, manufacturing cost can be reduced. Further, when the groove 13 is formed by physical processing, the shape of the groove 13 can vary due to wear of the tool and the like, which fluctuates the quality of the products, lowers the yield and complicates control of products to add to the manufacturing cost when the thermal heads 1 are mass-produced. To the contrast, when the groove 13 is formed by exposure of the photosensitive material layer 12, the shapes of the grooves are stabilized and fluctuation in the quality of the products is reduced, whereby the yield is increased and the manufacturing cost is reduced.

In addition, all of the contents of Japanese Patent Application No. 11(1999)-227329 are incorporated into this specification by reference.

What is claimed is:

1. A thick film thermal head comprising an electrical insulating substrate, a photosensitive material layer which is formed on the substrate and is provided with a linear groove formed on a surface thereof by exposing it to light, an elongated resistance heater embedded in the groove, and a plurality of electrodes which are formed on the surface of the photosensitive material layer in contact with the resistance heater and arranged in the longitudinal direction of the resistance heater.

2. A thick film thermal head as defined in claim 1 in which the electrodes comprise alternate first and second electrodes and the parts of the elongated resistance heater between the first and second electrodes generate heat when electric power is applied across the first and second electrodes.

3. A thick film thermal head as defined in claim 1 in which the substrate is of calcined ceramic.

4. A thick film thermal head as defined in claim 3 in which the photosensitive material layer is of heat-resistant photosetting resin.

* * * * *